US006901911B2

(12) United States Patent
Anderson et al.

(10) Patent No.: US 6,901,911 B2
(45) Date of Patent: Jun. 7, 2005

(54) PUMP AND HYDRAULIC SYSTEM WITH LOW PRESSURE PRIMING AND OVER PRESSURIZATION AVOIDANCE FEATURES

(75) Inventors: Michael D. Anderson, East Peoria, IL (US); Dennis H. Gibson, Chillicothe, IL (US); Michael E. Pickell, Metamora, IL (US); Jerry A. Wear, East Peoria, IL (US); Matthew D. Friede, Fort Wayne, IN (US)

(73) Assignee: Caterpillar Inc, Peoria, IL (US)

( * ) Notice: Subject to any disclaimer, the term of this patent is extended or adjusted under 35 U.S.C. 154(b) by 208 days.

(21) Appl. No.: 10/212,136

(22) Filed: Jul. 31, 2002

(65) Prior Publication Data

US 2004/0020463 A1 Feb. 5, 2004

(51) Int. Cl.[7] ..... F02M 37/04

(52) U.S. Cl. ..... 123/446; 123/506; 417/289; 417/270

(58) Field of Search ..... 125/446, 506, 125/449, 500, 501, 496; 417/269, 283, 284, 440, 63, 270, 289, 494, 495, 493, 499, 506

(56) References Cited

U.S. PATENT DOCUMENTS

| | | | | |
|---|---|---|---|---|
| 2,393,544 A | | 1/1946 | Lum | |
| 2,588,481 A | * | 3/1952 | Chandler | 417/270 |
| 2,982,216 A | * | 5/1961 | Huber | 417/289 |
| 3,016,018 A | * | 1/1962 | Williams | 417/304 |
| 3,758,241 A | * | 9/1973 | Eheim | 417/494 |
| 4,211,520 A | * | 7/1980 | Kranc | 417/494 |
| 4,531,492 A | | 7/1985 | Gibson | |
| 4,531,494 A | | 7/1985 | Bailey et al. | |
| 4,541,391 A | | 9/1985 | Gibson | |
| 5,357,912 A | | 10/1994 | Barnes et al. | |
| 5,404,855 A | | 4/1995 | Yen et al. | |
| 5,485,820 A | | 1/1996 | Iwaszkiewicz | |
| 5,515,829 A | | 5/1996 | Wear et al. | |
| 5,540,203 A | | 7/1996 | Foulkes et al. | |
| 5,564,386 A | | 10/1996 | Korte et al. | |
| 5,564,391 A | | 10/1996 | Barnes et al. | |
| 5,603,609 A | | 2/1997 | Kadlicko | |
| 6,035,828 A | * | 3/2000 | Anderson et al. | 123/446 |
| 6,216,670 B1 | | 4/2001 | Anderson et al. | |

FOREIGN PATENT DOCUMENTS

| | | |
|---|---|---|
| CH | 510199 | 4/1970 |
| EP | 0 307 947 A2 | 3/1989 |
| EP | 0 459 429 A1 | 12/1991 |
| WO | WO 97/47883 | 12/1997 |

* cited by examiner

*Primary Examiner*—Carl S. Miller
(74) *Attorney, Agent, or Firm*—Liell & McNeil

(57) ABSTRACT

A hydraulic system, such as a fuel injection system, includes a fixed displacement pump with at least one pump piston. A sleeve surrounds each pump piston and provides the method by which fluid displaced by the pumping stroke of the pump piston is directed either to a high pressure area in the pump or a low pressure area. The sleeves are a portion of an electro-hydraulic controller that includes a mechanical bias to bias the pump to a high output position when a pressure differential between the outlet area and the inlet area is relatively low, such as at cold start up. This aspect facilitates priming of the system. In addition, the controller includes a biasing hydraulic surface in opposition to the mechanical biaser that serves to bias the pump to its low output position when the pressure differential between the outlet area and the inlet area is relatively high. This aspect prevents over pressurization in the event that electric current to the controller is disrupted.

18 Claims, 8 Drawing Sheets

Fig_4a_
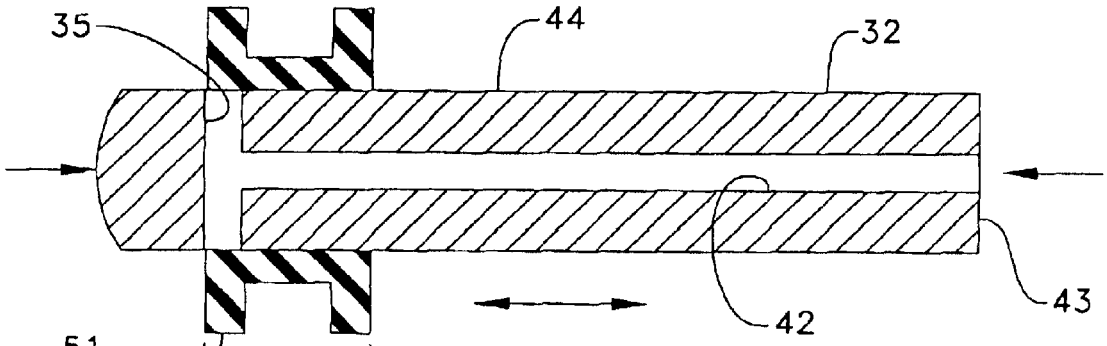
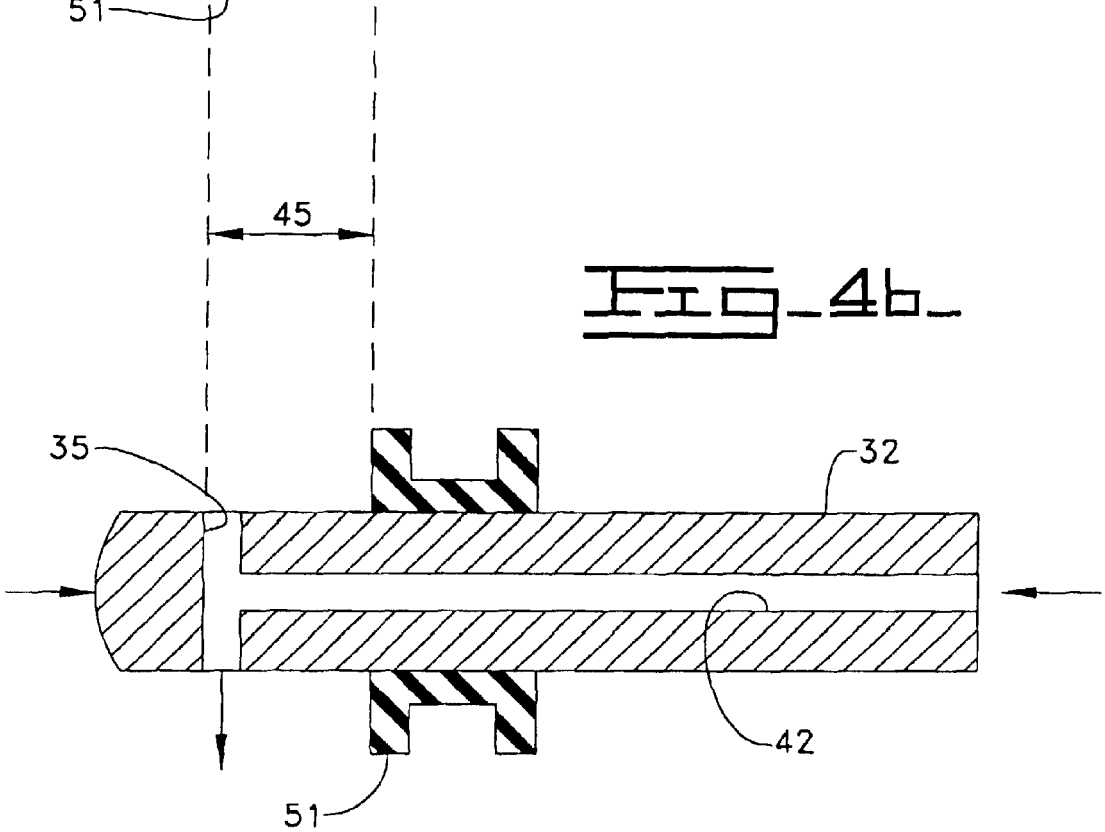
Fig_4b_

SOLENOID CURRENT

POPPET POSITION

SHAFT POSITION

SLEEVE POSITION
MAX
51
MIN
TIME(sec)

PRESSURE
HP
P
OUTLET
EP
INLET
LP
TIME(sec)

CONTROL CURRENT
MAX
I
0
TIME(sec)

PUMP AND HYDRAULIC SYSTEM WITH LOW PRESSURE PRIMING AND OVER PRESSURIZATION AVOIDANCE FEATURES

TECHNICAL FIELD

The present invention relates generally to hydraulically-actuated systems used with internal combustion engines, and more particularly to a pump and hydraulic system with electronic control and biasing features for priming and prevention of over pressurization.

BACKGROUND

U.S. Pat. No. 5,515,829 to Wear et al. describes a variable displacement actuating fluid pump for a hydraulically-actuated fuel injection system. In this system, a high pressure common rail supplies pressurized lubricating oil to a plurality of hydraulically-actuated fuel injectors mounted in a diesel engine. The common rail is pressurized by a variable displacement swash plate type pump that is driven directly by the engine. Pressure in the common rail is controlled in a two-fold manner. First, some pressure control is provided by electronically varying the swash plate angle within the pump. However, because variable angle swash plate type pumps typically have a relatively narrow band of displacement control, pressure in the common rail is primarily controlled through an electronically controlled pressure regulator. The pressure regulator returns a portion of the pressurized fluid in the common rail back to the low pressure fluid sump in order to maintain fluid pressure in the common rail at a desired magnitude.

While the Wear et al. hydraulically-actuated system using a variable displacement pump has performed magnificently for many years in a variety of diesel engines manufactured by Caterpillar, Inc. of Peoria, Ill., there remains room for improvement. For example, variable angle swash plate type pumps are relatively complex, and thus are more prone to mechanical break down relative to simple fixed displacement type pumps. In addition, the Wear et al. system inherently wastes energy that inevitably results in a higher than necessary fuel consumption for the engine. In other words, energy is wasted each time the pressure regulator spills an amount of pressurized fluid back to the low pressure sump in order to control rail pressure. The Wear et al. system primes itself by having its pump biased to produce substantial output, even when system pressures are low, such as during a cold start. The Wear et al. pressure regulating valve and/or a separate pressure relief valve provide the means by which system over pressurization is avoided.

The present invention is directed to overcoming problems associated with, and improving upon, hydraulic systems.

SUMMARY OF THE INVENTION

In one aspect, a liquid pump includes a pump body with an outlet area and an inlet area disposed therein. At least one pump piston is moveably positioned in the pump body. An electro-hydraulic controller is attached to the pump body and is moveable between a first position at which the pump piston displaces fluid in a large proportion to the outlet area relative to the inlet area, and a second position at which the pump piston displaces fluid in a small proportion to the outlet area relative to the inlet area. A mechanical biaser is operable to bias the electro-hydraulic controller toward the first position, but a biasing hydraulic surface is oriented in opposition to the mechanical biaser for hydraulically biasing toward the second position, when available control pressure is high. A control hydraulic surface is oriented in opposition to the biasing hydraulic surface.

In another aspect, a method of operating a liquid pump includes a step of biasing a controller of the liquid pump with a mechanical biaser toward a high output position when a pressure differential between an outlet area and an inlet area of the liquid pump is low. The mechanical bias is overcome with a hydraulic biaser to bias the controller of the liquid pump toward a low output position when the pressure differential is high.

In still another aspect, a hydraulic system includes a source of fluid and a common rail with at least one hydraulic device fluidly connected thereto. An electro-hydraulically controlled liquid pump has an inlet fluidly connected to the source of fluid, and an outlet fluidly connected to the common rail. The liquid pump is biased to displace a relatively small amount of fluid toward the common rail when a pressure differential between the common rail and the source of fluid is large. The liquid pump is biased to displace a relatively large amount of fluid toward the common rail when the pressure differential is small.

BRIEF DESCRIPTION OF THE DRAWINGS

FIGS. 4*a* and 4*b* are schematic illustrations of the sleeve metering control feature for the fixed displacement pump of FIG. 2;

DETAILED DESCRIPTION

Figure 1:
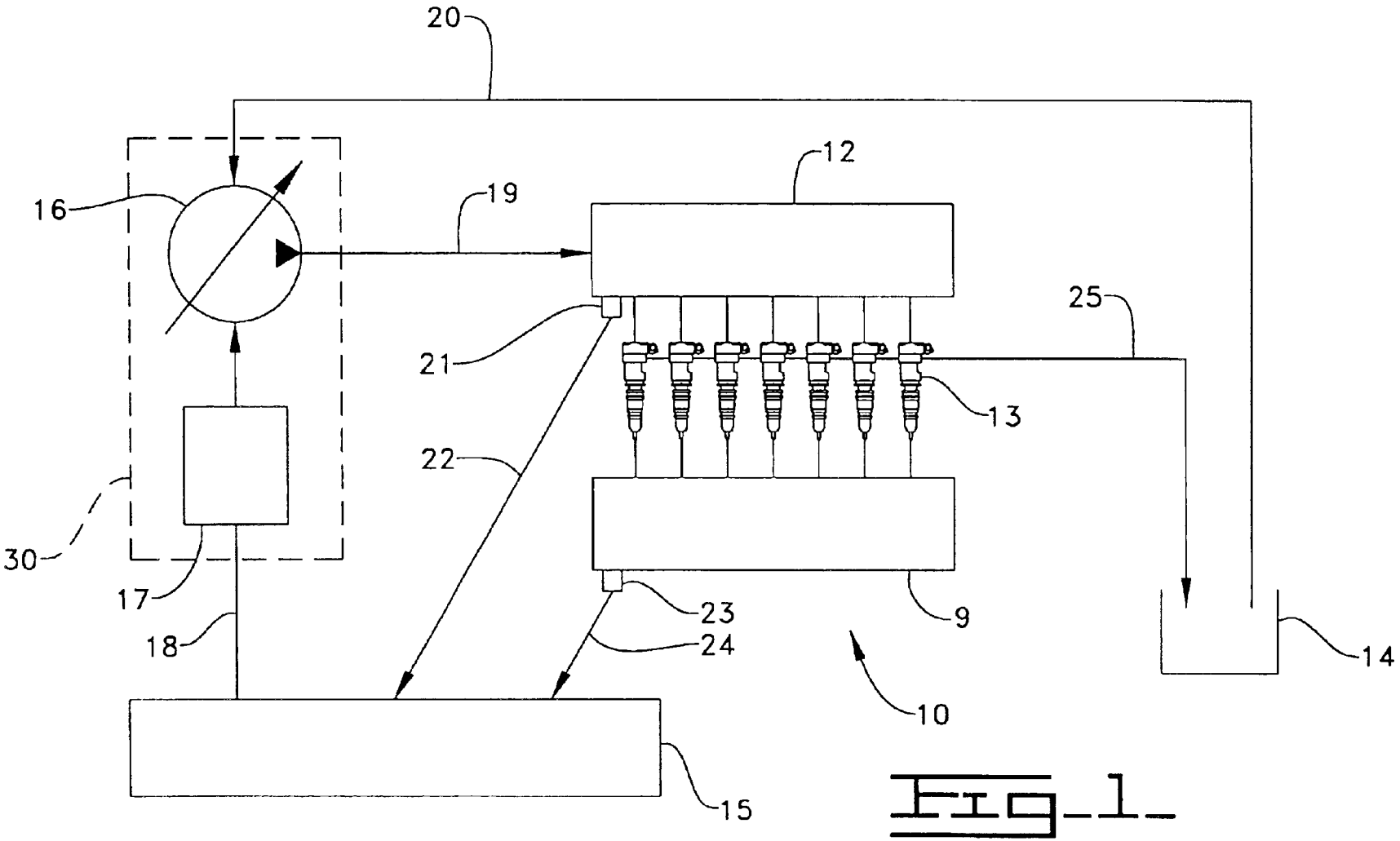
FIG. 1 is a schematic illustration of a hydraulically-actuated system according to the present invention.

Referring now to FIG. 1, a hydraulically actuated system 10 is attached to an internal combustion engine 9. The hydraulic system includes a high pressure common fluid rail 12 that supplies high pressure actuation fluid to a plurality of hydraulically-actuated devices, such as hydraulically-actuated fuel injectors 13. Those skilled in the art will appreciate that other hydraulically-actuated devices, such as actuators for gas exchange valves for engine brakes, could be substituted for, or added to, the fuel injectors 13 illustrated in the example embodiment. Common rail 12 is pressurized by a variable delivery fixed displacement pump 16 via a high pressure supply conduit 19. Pump 16 draws actuation fluid along a low pressure supply conduit 20 from a source of low pressure fluid 14, which is preferably the engine's lubricating oil sump. Although other available liquids could be used, the present invention preferably utilizes engine lubricating oil as its hydraulic medium. After the high pressure fluid does work in the individual fuel injectors 13, the actuating fluid is returned to sump 14 via a drain passage 25.

As is well known in the art, the desired pressure in common rail 12 is generally a function of the engine's operating condition. For instance, at high speeds and loads, the rail pressure is generally desired to be significantly higher than the desired rail pressure when the engine is operating at an idle condition. An operating condition sensor 23 is attached to engine 9 and periodically provides an electronic control module 15 with sensor data, which includes engine speed and load conditions, via a communication line 24. In addition, a pressure sensor 21 periodically provide electronic control module 15 with the measured fluid pressure in common rail 12 via a communication line 22. The electronic control module 15 compares a desired rail pressure, which is a function of the engine operating condition, with the actual rail pressure provided by pressure sensor 21.

If the desired and measured rail pressures are different, the electronic control module 15 commands movement of a control valve 17 via a communication line 18. Control valve 17 is preferably a portion of an electro-hydraulic controller 65. The position of control valve 17 determines the amount of fluid that leaves pump 16 via high pressure supply conduit 19 to high pressure rail 12. Both control valve 17 and pump 16 are preferably contained in a single pump housing 30. Unlike prior art hydraulic systems, the present invention controls pressure in common rail 12 by controlling the delivery output from pump 16, rather than by wasting energy through the drainage of pressurized fluid from common rail 12 in order to achieve a desired pressure.

Figure 2:
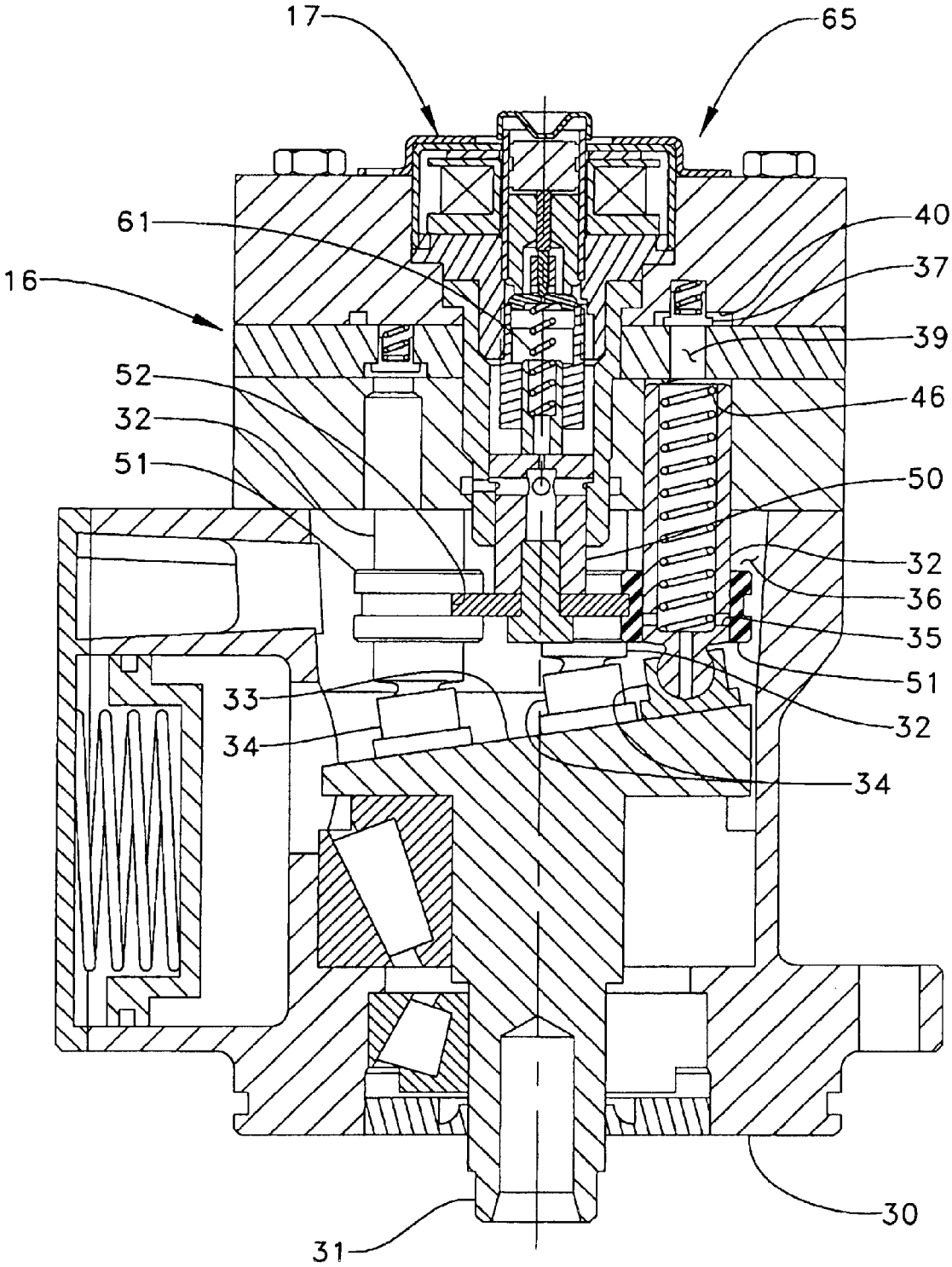
FIG. 2 is a sectioned side diagrammatic view of a fixed displacement pump according to one aspect of the present invention.
Figure 3:
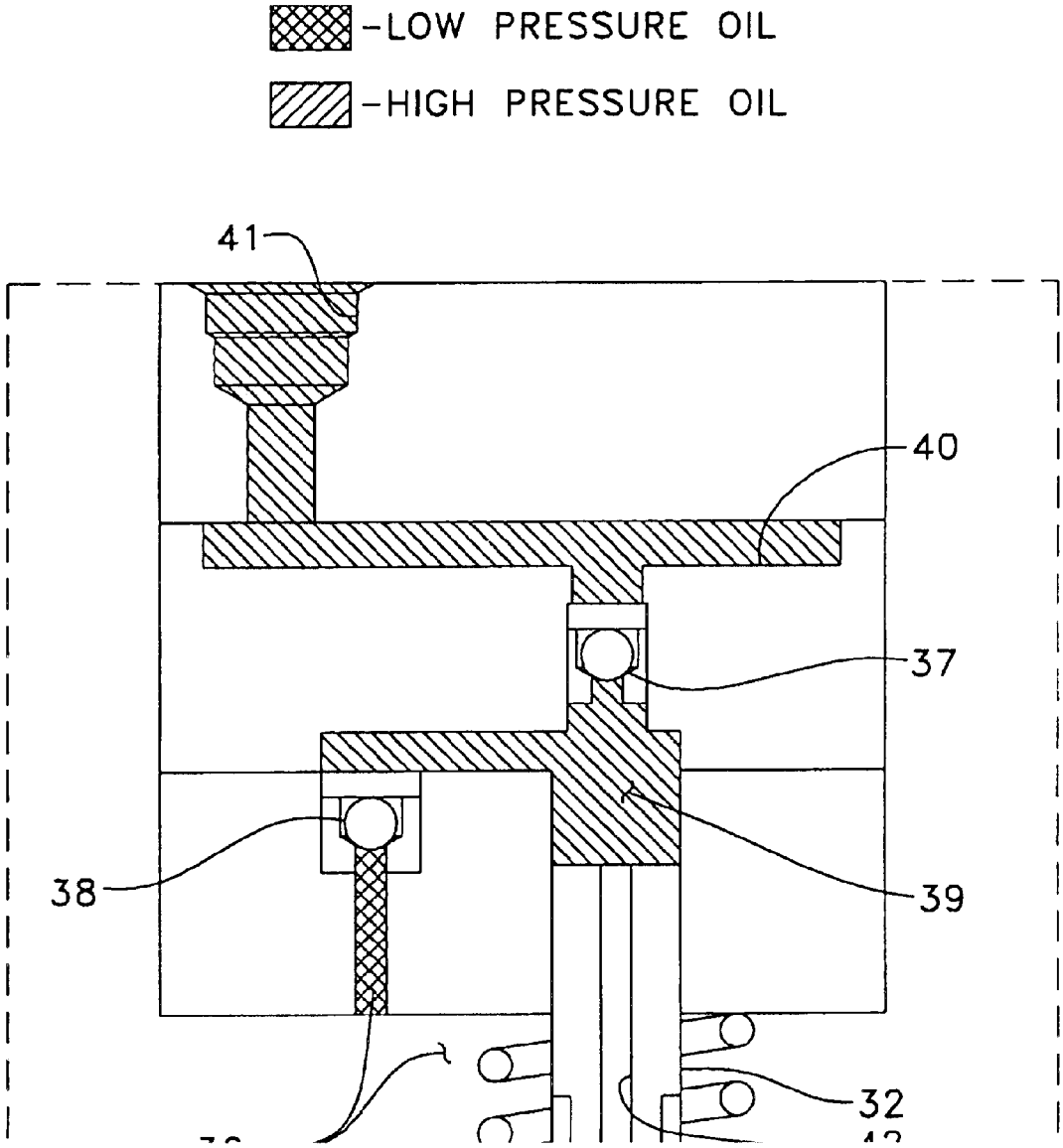
FIG. 3 is a schematic illustration of the fluid plumbing for one piston of the fixed displacement pump of FIG. 2.

Referring now to FIGS. 2–4, the various features of pump 16 are contained within a pump housing 30. Liquid pump 16 includes a rotating shaft 31 that is coupled directly to the output of the engine, such that the rotation rate of shaft 31 is directly proportional to the drive shaft of the engine. Nevertheless, those skilled in the art will appreciate that shaft 31 could be rotated indirectly by the engine or by some other machinery. A fixed angle swash plate 33 is attached to shaft 31, but the invention also contemplates variable angle swash plates. The rotation of swash plate 33 causes a plurality of parallel disposed pistons 32 to reciprocate from left to right. In this example, pump 16 includes five pistons 32 that are continuously urged toward swash plate 33 by individual return springs 46. Return springs 46 maintain shoes 34, which are attached to one end of each piston 32 in contact with swash plate 33 in a conventional manner. Because swash plate 33 has a fixed angle, pistons 32 reciprocate through a fixed reciprocation distance with each rotation of shaft 31. Thus, pump 16 can be thought of as a fixed displacement pump; however, control valve 17 determines whether the fluid displaced is pushed into a high pressure outlet area 40 past check valve 37 or spilled back into a low pressure inlet area 36 via a spill port 35.

The proportion of fluid displaced by pistons 32 to the respective high pressure are 40 (See FIG. 3) and low pressure area 36 within pump housing 30 is determined by the position of individual sleeves 51 that are mounted to move on the outer surface of the individual pistons 32. Each sleeve 51 is connected to move with a central actuator shaft 50 via an annulus 52. An actuator biasing spring 61 normally biases actuator shaft 50 toward shaft 31 to a position in which virtually all the fluid displaced by the individual pistons 32 is displaced into high pressure space 40, since spill ports 35 remain closed during the entire pumping stroke. The mechanical bias provided by spring 61 helps facilitate priming of pump 16. Although electro-hydraulic controller 65 includes internal hydraulic surfaces that facilitate operation and control of output from pump 16 when system pressures are relatively high, these surfaces are of little help when starting the system at low pressure. Thus, spring 61 serves as a means by which the system can prime and come up to pressure during a cold start without reliance upon some stored source of pressurized fluid or some other means, in order to bias the electro-hydraulic controller 65 to a position that produces maximum output into high pressure space 40. Those skilled in the art will appreciate that the pressure differential between high pressure space 40 and low pressure space 36 during a cold start up is small to non existent.

Pressure within pumping chamber 39, under each piston 32, can only build when internal passage 42 and spill port 35 are covered by a sleeve 51. When sleeve 51 covers spill port 35, fluid displaced by piston 30 is pushed past check valve 37, into a high pressure connecting annulus 40 and eventually out of outlet 41 to the high pressure rail 12. When pistons 32 are undergoing the retracting portion of their stroke due to the action of return spring 46, low pressure fluid is drawn into pumping chamber 39 from a low pressure area 36 within pump housing 30 past inlet check valve 38. Although the present invention prefers that electro-hydraulic controller 65 utilize sleeves that are moveable axially with respect to pistons 32 as a means by which spillage back to low pressure area 36 is controlled, those skilled in the art will appreciate that other spill control mechanisms could be substituted without departing from the intended scope of the present invention.

Referring now specifically to FIGS. 4*a* and 4*b*, the internal passage 42 within each piston 32 extends between its pressure face end 43 and its side surface 44. In this embodiment, the height of the individual sleeves 51 is about equal to the fixed reciprocation distance 45 of pistons 32. In this way, when sleeve 51 is in the position shown in FIG. 4*a*, all of fluid displaced by piston 32 is pushed into the high pressure area 40 (FIG. 3) within the pump 16. On the other hand, when sleeve 51 is in the position shown in FIG. 4*b*, virtually all of the fluid displaced by piston 32 is spilled back into low pressure area 36 (FIGS. 2 and 3) within pump 16 via internal passage 42 and spill port 35. Thus, pump 16 can be characterized as variable delivery since the high pressure output is variable, but also be characterized as a fixed displacement swash plate type pump since the pistons always reciprocate a fixed distance and displace a fixed volume of fluid.

Figure 5:
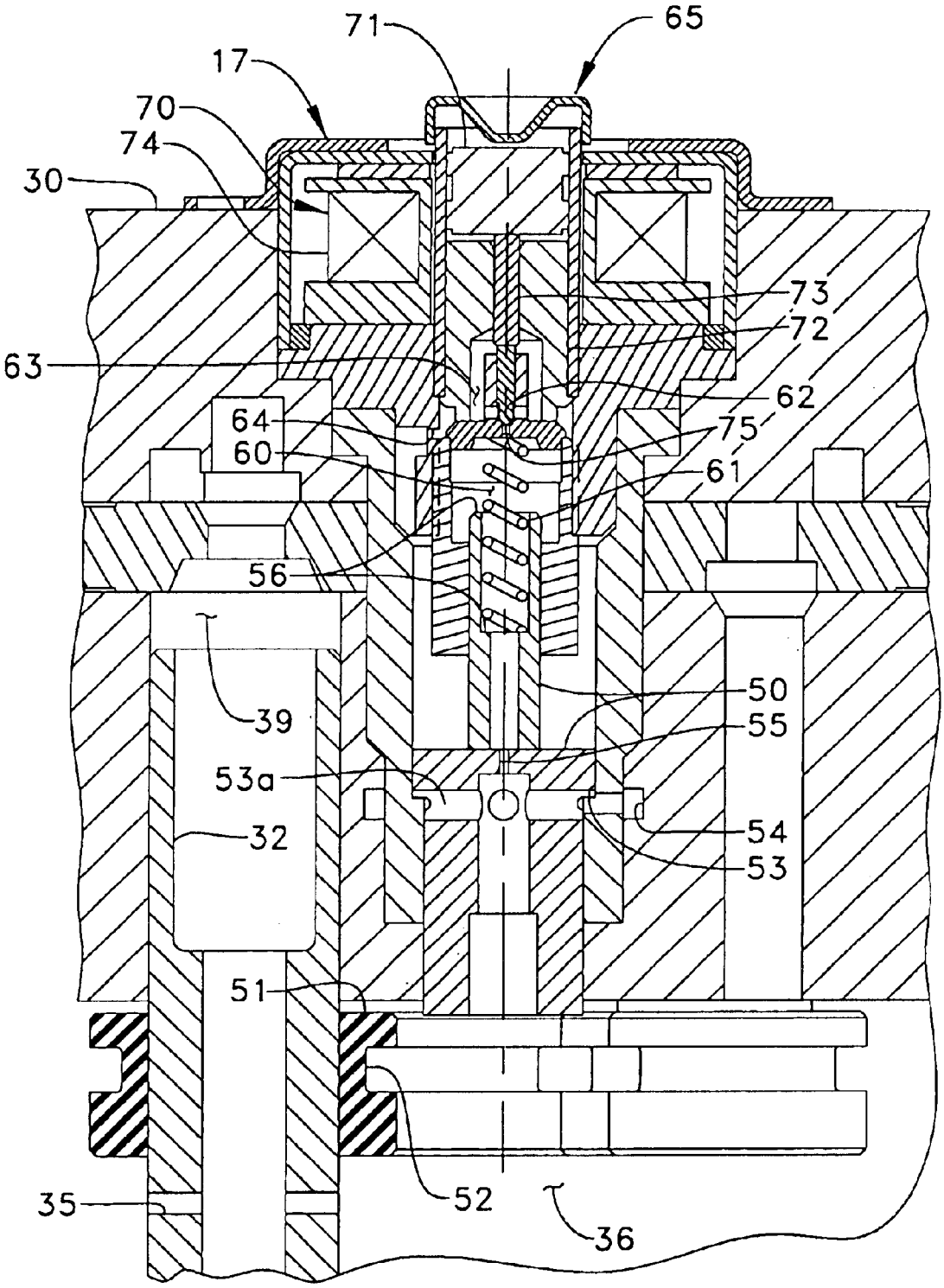
FIG. 5 is an enlarged side sectioned diagrammatic view of a control valve for controlling the delivery output of the fixed displacement pump of FIG. 2.

Referring now to FIG. 5, the internal structure of electro-hydraulic controller 65, which includes control valve 17 and sleeves 51, is illustrated. Electro-hydraulic controller 65 includes a linear actuator 70 that includes a solenoid armature 71, a stator 72, and a solenoid coil 74. A poppet valve member 73 is moved toward valve seat 62 when current is supplied to solenoid coil 74. Thus, when current is high, poppet valve member 73 is seated in valve seat 62 to close fluid communication between control volume 60 and a low pressure area 63, which is in fluid communication with a low pressure passage 64. Passage 64 is preferably fluidly connected to low pressure area 36 via a passage that is not shown. When current is lower, fluid pressure in control volume 60 pushes on tip hydraulic surface 75 of poppet valve member 73, causing it and armature 71 to move toward the right to open some fluid communication between control volume 60 and low pressure area 63 past valve seat 62. Thus, depending upon the fluid pressure in control chamber 60 and the current supplied to solenoid coil 70, the flow area past valve seat 62 can be precisely controlled. This in turn provides a means by which pressure in control volume 60 can be controlled to some pressure that is between that existing in the high pressure outlet area 40 and the low pressure inlet area 36.

As stated earlier, actuator shaft 50 is normally biased away from coil 74 by a biasing spring 61. In addition to this spring force, actuator shaft 50 has a pair of opposing hydraulic surfaces that provide the means by which actuator shaft 50, and hence sleeves 51 are moved and stopped between the respective positions shown in FIGS. 4*a* and 4*b*. In particular, actuator shaft 50 includes a shoulder biasing hydraulic surface 53 that is exposed to fluid pressure in a biasing volume 53*a*, which is always in fluid communication with the high pressure area 40 within pump 16 via a high pressure conduit 54. Thus, biasing hydraulic surface 53 is oriented in opposition to spring 61 such that a hydraulic force would tend to bias shaft 50 toward a low output position as shown in FIG. 5. This high fluid pressure in conduit 54 is channeled via central restricted communication passage 55 into control volume 60. Fluid pressure in control volume 60 acts on a control hydraulic pressure surface 56, which is preferably about equal to the hydraulic surface area defined by shoulder area 53. Thus, when fluid pressure in control volume 60 is equal to the high pressure in conduit 54, the only force acting on actuator shaft 50 comes from biasing spring 61. This occurs when current to solenoid coil 70 is high such that poppet valve member 73 is pushed to close fluid flow past valve seat 62. When current to solenoid coil 74 is turned off, poppet valve member 73 is pushed off of valve seat 62 and the resulting fluid flow into low pressure area 63 lowers pressure in control volume 60 sufficiently that actuator shaft 50 has a tendency to move completely to the right under the action of the high fluid pressure force acting on shoulder area 53. The pressure in control volume 60, and hence the position of actuator shaft 50 can be controlled to stop at any position depending upon the magnitude of the current being supplied to solenoid current 74. Thus, depending upon the current to solenoid coil 74, the amount of fluid pumped into the high pressure rail can be varied from zero to the maximum output of the pump. In the event of an electrical malfunction, over-pressurization of the rail is prevented since the actuator shaft 50 is hydraulically biased to a position as shown in FIG. 5 in which no high pressure output is produced. Thus, when system pressure is relatively high, and current to solenoid coil 74 ceases, the pressure in control volume 60 acts upon tip hydraulic surface 75 of valve member 73 pushing it to an open position, which relieves pressure in control volume 60. This lowered pressure force on control hydraulic surface 56 combined with the spring force produced by biasing spring 61 is preferably overcome by the biasing force on biasing hydraulic surface 53 such that shaft 50 will move toward coil 74 to a zero output position as shown in FIG. 5. This aspect of the pump prevents over pressurization.

When pressure is low throughout the system, such as during a cold start, pressures everywhere in the pump are relatively low. When this occurs, biasing spring 61 provides a dominate force in electro-hydraulic controller 65 causing it to move away from coil 74 to a position as shown in FIG. 2 in which substantially all of the fluid displaced by pump pistons 32 is pushed in the high pressure area. Thus, the pump includes a mechanical bias that facilitates priming, but that mechanical bias can be overcome at system pressures to bias the pump toward a low output position to prevent over pressurization in the event of electrical failure to electro-hydraulic controller 65.

Figure 7:
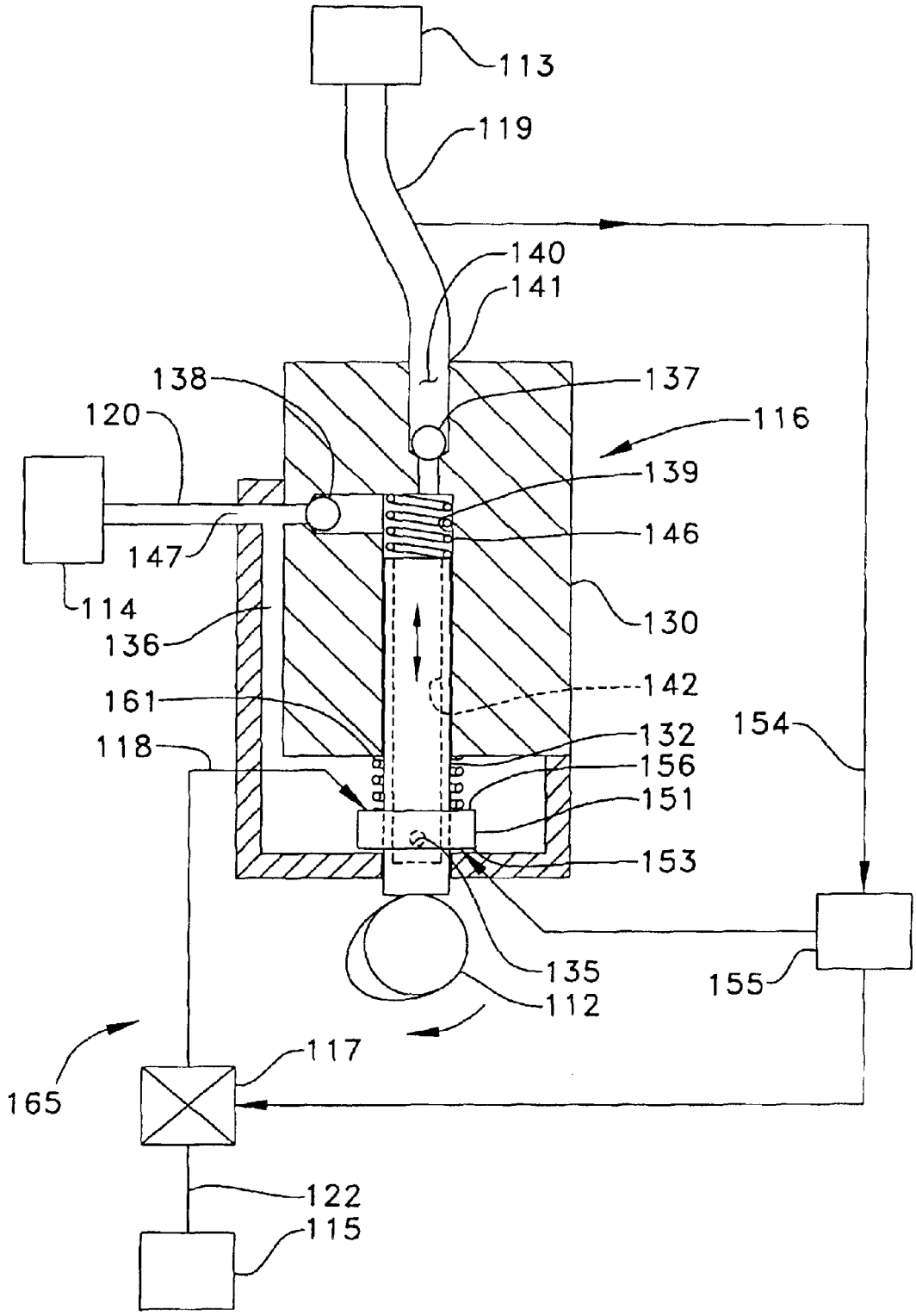
FIG. 7 is a schematic illustration of a unit pump embodiment of the present invention.

Referring now to FIG. 7, a unit pump 116 version of the present invention is illustrated. In this embodiment, a cam 112 rotates to drive the reciprocation of a piston 132 that is at least partially positioned within a pump housing 130. The pump housing 130 defines a low pressure area 136 that includes an inlet 147 connected to a source of low pressure fluid 114 via a low pressure supply line 120. The pump housing 130 also defines a high pressure area 140 that includes an outlet 141 fluidly connected to a hydraulically-actuated device 113 via a high pressure supply line 119. The piston 132 and the pump housing 130 define a pump chamber 139 that is fluidly connected to the low pressure area 136 and the high pressure area 140 past respective check valves 138 and 139 in a conventional manner. Piston 132 is biased toward a retracted position to follow the contour of cam 112 by a return spring 146. As with the previous embodiment, piston 130 reciprocates through a fixed distance and thus displaces a fixed amount of fluid with each reciprocation. However, the relative proportions of the fluid displaced to high pressure area 140 and low pressure area 136 is controlled by the positioning of a sleeve 151. When sleeve 151 is in the position shown, virtually all of the fluid displaced by the movement of piston 132 is displaced into low pressure area 136 due to the fluid connection between pumping chamber 139 via internal passage 142 and spill port 135. The positioning of sleeve 151 is controlled via a suitable mechanical and/or hydraulic linkage to a control valve 117, which can be of a type described earlier. In other words, control valve 117 is controlled in its position via an electronic control module 115 via a communication line 122 in a conventional manner.

The embodiment shown in FIG. 7 is substantially similar to the earlier embodiment except that it is a unit pump containing only one pump piston verses a multi-piston swash plate type pump of the type earlier described. Nevertheless, it includes sleeve metering and an electro-hydraulic controller 165 similar in construction to that described earlier. In other words, a spring 161 normally biases sleeve 151 toward a position that produces maximum output in order to facilitate priming. Electro-hydraulic controller 165 also includes a biasing hydraulic surface 153 that is oriented in opposition to spring 161. In addition, a control hydraulic surface 156 is oriented in opposition to biasing hydraulic surface 153. Control valve 117, which is a portion of electro-hydraulic controller 165, controls the pressure force on control hydraulic surface 156 via high pressure fluid supplied from high pressure area 140 via high pressure control line 154. The pressure on biasing hydraulic surface 153 is always relatively high. This embodiment also could differ from the earlier embodiment by the inclusion of a pressure reduction valve 155 so that the control function of the pump can consume less hydraulic fluid to perform its function. This aspect of the invention can be facilitated by appropriately sizing hydraulic surfaces 153 and 156 relative to spring strength 161 and other known factors. Thus, the earlier embodiment could also utilize a pressure reduction valve with appropriate spring strength and hydraulic surface area sizing to allow it to perform its control function with a reduced consumption of the pump's high pressure output.

Industrial Applicability

Figure 6A:
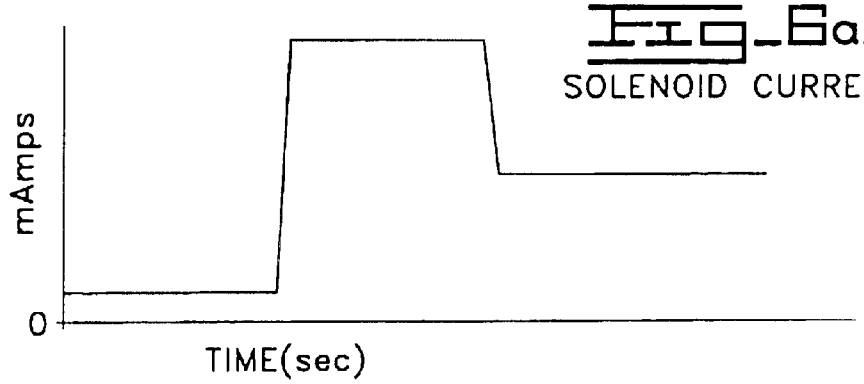
FIGS. 6*a–d* are graphs of solenoid current fluid pressure, poppet valve position and sleeve position, respectively, versus time for the hydraulically-actuated system of the present invention.
Figure 6B:
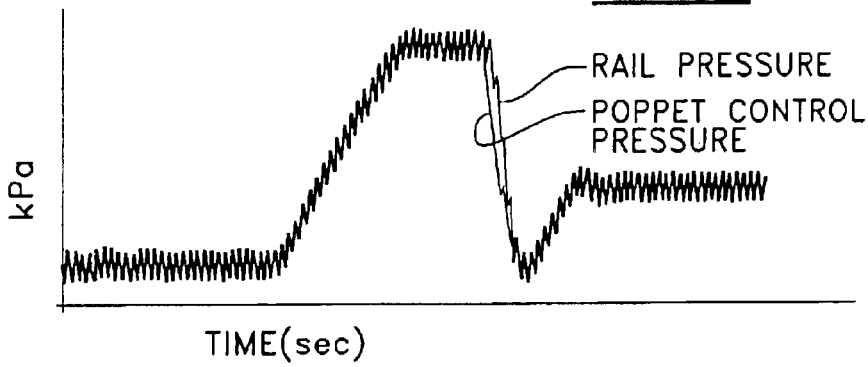
Figure 6C:
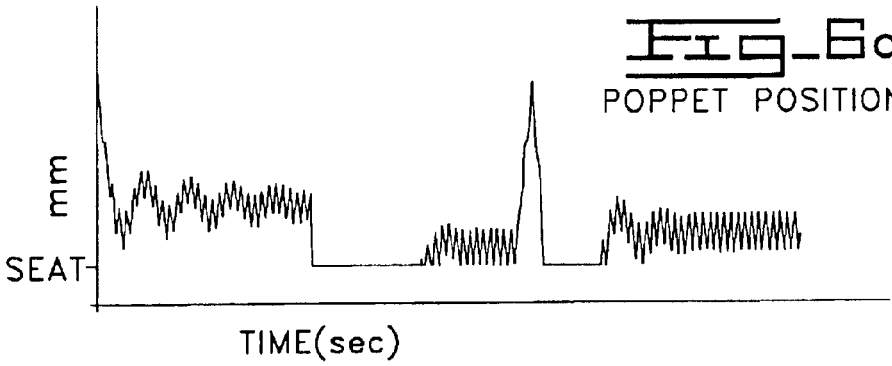
Figure 6D:
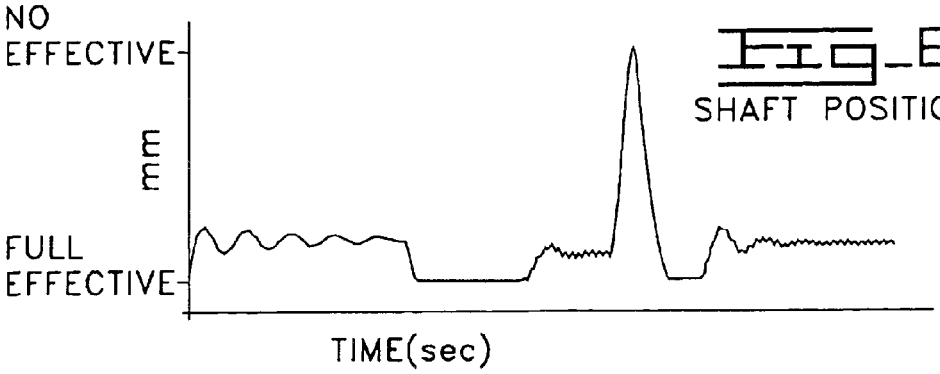

Referring now in addition to FIGS. 6*a–d*, the operation of hydraulically-actuated system 10 will be described and illustrated. FIGS. 6*a* and 6*b* illustrate that the steady state rail pressure is directly proportional to the steady state current being supplied to the solenoid portion of electro-hydraulic controller 65. The graphs of FIGS. 6*a–d* reflect system operation when the pressure differential between outlet area 40 and inlet area 36 is high, such as during normal operation. When solenoid current is low, rail pressure remains at the lower end of its high pressure range. When solenoid current is high, rail pressure is raised accordingly. A medium current puts the rail pressure at a medium magnitude. The variation in solenoid current changes the amount of fluid being spilled past valve seat 62 (a controlled leakage flow area) which changes the fluid pressure in control volume 60. With each change in fluid pressure within control volume 60, actuator shaft 50 will seek out a new equilibrium position in which the hydraulic force acting on biasing hydraulic surface 53 is balanced against the combined forces from spring 61 and the hydraulic force acting on control hydraulic surface 56.

Of interest in FIGS. 6*a*–6*d* is when the system is commanded to raise rail pressure. When this occurs, solenoid current jumps and the poppet valve member is driven to close valve seat 62. This in turn causes actuator shaft 50 to move to the position shown in FIG. 2 such that the complete stroke of the piston is utilized to pressurize fluid. This causes a rapid rise in rail pressure. When it is desired to lower the rail pressure, current to the solenoid is decreased. This quickly causes actuator shaft 50 to move toward the position shown in FIG. 5 where the pistons have no effective pumping stroke. Pressure in the rail quickly drops as the hydraulically-actuated devices 13 continue to operate and consume the pressurized fluid in the common rail 12. In addition, some steady drop in pressure will occur due to flow of high pressure fluid into control volume 60 and back to low pressure area 36 to perform the control function.

Referring again to FIG. 7, when in operation in a hydraulic system, the unit pump 116 has the ability to deliver a precise amount of pressurized fluid to the particular hydraulically-actuated device 113. For instance, if hydraulically-actuated device 113 were a fuel injector, the amount of fuel injected can be about equal to the amount of fuel pressurized by unit pump 116, thereby avoiding wasted energy that occurs by pressurizing fluid only to spill a substantial amount of that pressurized fluid back for repressurization because it is not needed for a particular injection event. Those skilled in the art will appreciate that although the preferred version of the present invention includes sleeves that open and close a spill port on a pumping piston, some other suitable structure could be substituted that accomplishes the same task, such as some other component that opens and closes the spill port incorporated into the piston for a portion of its reciprocation distance.

Figure 8A:
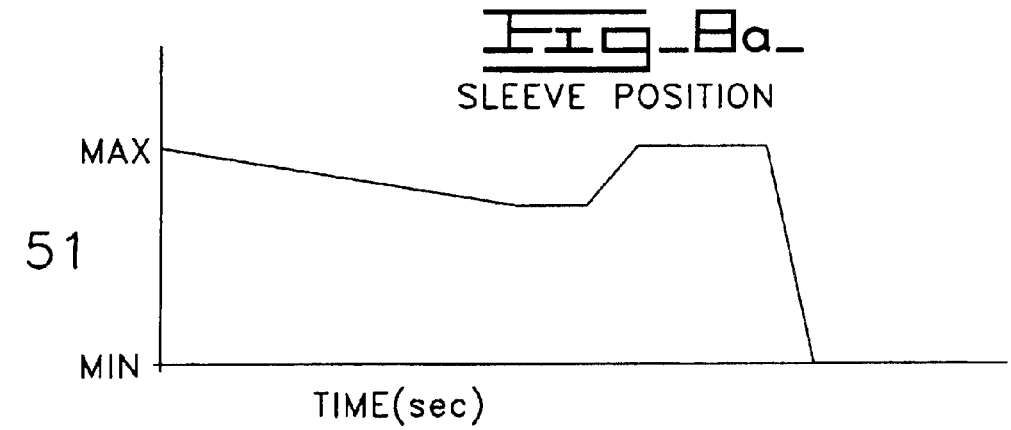
FIGS. 8*a–c* are graphs of sleeve position, pump pressure and controller electric current verses time for one example pump priming event.
Figure 8B:
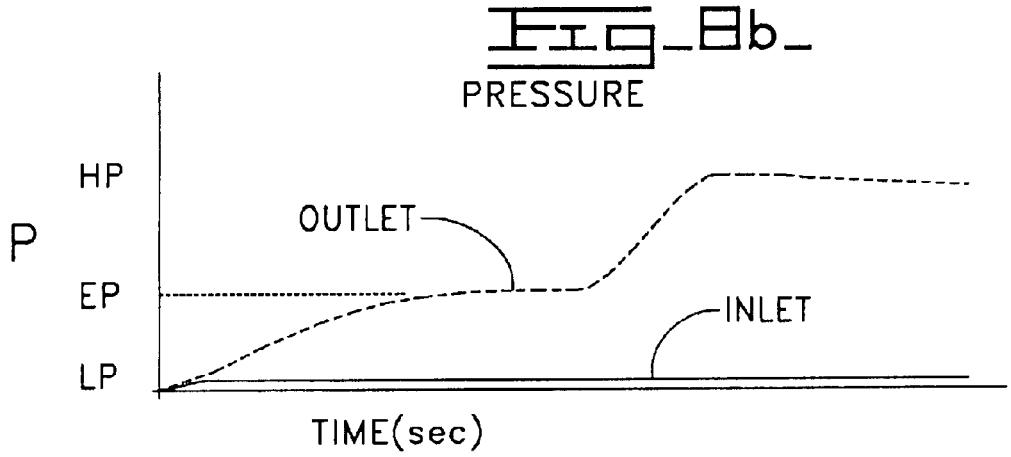
Figure 8C:
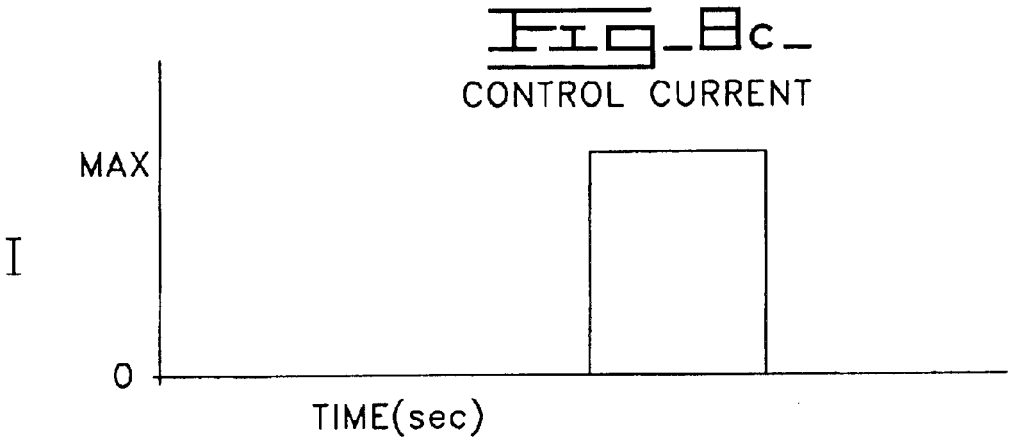

Referring now to FIGS. 8*a*–8*c*, an example priming sequence for the pump of the present invention is illustrated. At the beginning time, the sleeve position is biased to a maximum output position by the mechanical biasing spring 61, 161; pressure throughout the pump is low; and current to the electro-hydraulic controller 65, 165 is at zero. As a pump piston(s) starts to move via rotation of its shaft as shown in FIG. 2 embodiment or by the cam of the FIG. 7 embodiment, fluid begins to be displaced into the high pressure area of the pump. This causes pressure in the outlet area to rise while pressure in the inlet area remains low. If no current were supplied to electro-hydraulic controller 65, the pump would seek out an equilibrium pressure (EP) that reflects a balance between substantially all of the high pressure output of the pump being consumed through electro-hydraulic controller 65. Thus, without any electrical current, the pump will come up to an operational pressure (EP) that produces sufficient pressure that the electro-hydraulic controller can operate effectively. This pressure is preferably high enough that the hydraulic system can still operate in a lower performance mode in the event of a voltage drop in the entire system. In other words, this pressure is preferably high enough to provide a limp home pressure that would allow the hydraulic system to operate. After reaching this equilibrium pressure, electric current can be supplied to electro-hydraulic controller 65, 165 to move the sleeves toward there maximum output position to raise pump outlet pressure to regular system levels. Once reaching the system pressure levels, if current to the electro-hydraulic controller 65, 165 is dropped back to zero, the sleeves will quickly move the their minimum or no output position as shown in FIG. 8*a*, and pressure will decay due to fluid leakage losses through electro-hydraulic controller 65, 165. If current were not resupplied to adjust the pressure to some desired level, the pump would again seek out the equilibrium pressure level EP after some time delay. Thus, the present invention has a mechanical biasing feature that facilitates priming without any electrical current or stored fluid pressure, yet retains over pressurization prevention features via hydraulic biasing that prevents the system from becoming over pressurized when pressure is high and current to electro-hydraulic controller 65, 165 is disrupted for whatever reason.

The present invention decreases the complexity of prior art hydraulically-actuated systems by having only one electronically-controlled device for controlling pressure in the high pressure rail. Recalling in the prior art, two different control schemes were necessary as one controlled the swash plate angle in the pump and the other controlled the pressure regulator attached to the high pressure rail. The present invention accomplishes the same task by only controlling high pressure output from the pump. The present invention also improves the robustness of the hydraulically-actuated system since fixed angle swash plate type pumps are generally more reliable and less complex than the variable angle swash plate type pumps of the prior art. In addition, only one electronically-controlled actuator is utilized in the present invention. Finally, the overall fuel consumption of the engine utilizing the present invention should be improved over that of the prior art since the pump only pressurizes an amount of fluid that is actually used by the hydraulic devices, and therefore very little energy is wasted. Recalling that in the case of the prior art, pressure in the common rail was maintained at least in part by returning an amount of pressurized fluid back to the sump, which resulted in an efficiency drop and waste of energy.

The above description is intended for illustrative purposes only, and is not intended to limit the scope of the present invention in any way. For instance, other types of control valves could be substituted for the example illustrated control valve without departing from the intended scope of the present invention. Thus, those skilled in the art will appreciate that various modifications can be made to the illustrated embodiment without departing from the spirit and scope of the present invention, which is defined in terms of the claims set forth below.

What is claimed is:

1. A liquid pump comprising:

a pump body having disposed therein an outlet area, at least one pumping chamber and an inlet area;

a check valve separating the outlet area from the at least one pumping chamber;

at least one pump piston moveably positioned in said pump body; and an electro-hydraulic controller attached to said pump body and being moveable between a first position at which said pump piston displaces fluid in a large proportion to said outlet area relative to said inlet area, and a second position at which said pump piston displaces fluid in a small proportion to said outlet area relative to said inlet area, and including a mechanical biaser operable to bias said electro-hydraulic controller toward said first position, and including a biasing hydraulic surface oriented in opposition to said mechanical biaser for hydraulic biasing toward said second position, and including a control hydraulic surface oriented in opposition to said biasing hydraulic surface;

said control hydraulic surface is exposed to fluid pressure in a control volume fluidly connected to said outlet area;

said biasing hydraulic surface is exposed to fluid pressure in a biasing volume fluidly connected to said outlet area; and said control volume and said biasing volume are fluidly connected to said outlet area via a pressure reduction valve that is located downstream from the check valve.

2. The liquid pump of claim 1 wherein said electro-hydraulic controller includes a moveable sleeve disposed around each of said at least one pump piston.

3. The liquid pump of claim 1 wherein said large proportion corresponds to all fluid to said outlet area; and said small proportion corresponds to all fluid to said inlet area.

4. The liquid pump of claim 1 wherein said electro-hydraulic controller includes an electrical actuator operably coupled to move a valve member with respect to a valve seat; and said valve member has an opening hydraulic surface exposed to fluid pressure in a control volume.

5. The liquid pump of claim 1 wherein said pump piston displaces a fixed volume of fluid with each reciprocation that is divided between said inlet area and said outlet area.

6. A method of operating a liquid pump, comprising the steps of:

biasing a controller of the liquid pump with a mechanical biaser toward a high output position when a pressure differential between an outlet area and an inlet area of the liquid pump is low; and overcoming the mechanical bias with a hydraulic biaser to bias the controller of the liquid pump toward a low output position when the pressure differential is high; and adjusting a pump output at least in part by supplying the controller with liquid from the outlet area via a pressure reduction valve that is located downstream from a check valve separating the outlet area from a pumping chamber.

7. The method of claim 6 including a step of increasing output from the pump when the pressure differential is high at least in part by increasing electrical energy supplied to an electrical actuator portion of the controller.

8. The method of claim 6 including a step of decreasing output from the pump when the pressure differential is high at least in part by decreasing electrical energy supplied to the electrical actuator portion of the controller.

9. The method of claim 6 including a step of adjusting output from the liquid pump at least in part by moving a sleeve surrounding a pump piston.

10. The method of claim 11 wherein said adjusting step includes changing a flow area between a control volume and a low pressure area.

11. The method of claim 10 wherein said changing step includes moving a valve member with respect to a valve seat with an electrical actuator.

12. A hydraulic system comprising:

a source of fluid;

a common rail;

at least one hydraulic device with an inlet fluidly connect to said common rail;

an electro-hydraulically controlled liquid pump with an inlet fluidly connected to said source of fluid, and an outlet fluidly connected to said common rail, and at least one pumping chamber separated from the outlet by a check valve, and including a controller fluidly connected to said outlet rail via a pressure reduction valve that is located downstream from the check valve;

said liquid pump being biased to displace a relatively small amount of fluid toward said common rail when a pressure differential between said common rail and said source of fluid is large; and said liquid pump being biased to displace a relatively large amount of fluid toward said common rail when the pressure differential is small.

13. The hydraulic system of claim 12 wherein said liquid pump is a sleeve metered fixed displacement pump.

14. The hydraulic system of claim 12 wherein said at least one hydraulic device includes a plurality of hydraulically actuated fuel injectors.

15. The hydraulic system of claim 12 wherein said liquid pump includes an electro-hydraulic controller with a mechanical biaser, and a control hydraulic surface in opposition to a biasing hydraulic surface.

16. The hydraulic system of claim 15 wherein said control hydraulic surface is exposed to fluid pressure in a control volume; and said electro-hydraulic controller includes a variable flow area valve coupled to an electrical actuator.

17. The hydraulic system of claim 16 wherein said liquid pump is a sleeve metered fixed displacement pump.

18. The hydraulic system of claim 17 wherein said at least one hydraulic device includes a plurality of hydraulically actuated fuel injectors.

* * * * *